United States Patent [19]

Alfin et al.

[11] 4,018,658

[45] Apr. 19, 1977

[54] ELECTROPLATING OF RECOVERABLE SILVER FROM PHOTOGRAPHIC SOLUTIONS AND CELL WITH CURRENT CONTROL MEANS THEREFOR

[75] Inventors: Norman J. Alfin, Glen Arm; Robert Scott, Westminster, both of Md.

[73] Assignee: Merlin Industries, Inc., Westminster, Md.

[22] Filed: Dec. 26, 1974

[21] Appl. No.: 536,463

[52] U.S. Cl. ..... 204/109; 204/228; 204/272; 204/273; 204/275

[51] Int. Cl.[2] ..... C25C 1/20; C25C 7/00

[58] Field of Search ..... 204/228, 109, 272, 273, 204/231, 275

[56] References Cited

UNITED STATES PATENTS

| | | | |
|---|---|---|---|
| 3,551,318 | 12/1970 | Snook et al. | 204/228 |
| 3,616,435 | 10/1971 | Favell et al. | 204/228 |
| 3,875,032 | 4/1975 | Thompson | 204/109 |
| 3,925,184 | 12/1975 | Cave | 204/229 |

FOREIGN PATENTS OR APPLICATIONS

| | | | |
|---|---|---|---|
| 1,123,168 | 8/1968 | United Kingdom | 204/272 |
| 916,438 | 1/1963 | United Kingdom | 204/272 |

*Primary Examiner*—G. L. Kaplan
*Attorney, Agent, or Firm*—Pollock, Vande Sande & Priddy

[57] ABSTRACT

A system for optimizing current density versus voltage across a device for electroplating recoverablesilver from expended photographic solutions by controlling voltage applied across the electrodes of the device as a controlled function of current flow through the device, current being sensed in terms of voltage across a resistance in series with the device, and that voltage, after comparison with reference voltages being employed to control a voltage regulator in the circuit between a source of dc voltage and the electrodes. The cathode of the device is a removable flexible stainless steel cylinder, and is contained in a cylindrical tank of larger diameter than that of the cathode. The anode is a hollow graphite cylinder on which pivots an arm bearing two stirring paddles which is rotated from interiorly of the anode by means of a magnetic clutch.

20 Claims, 4 Drawing Figures

ELECTROPLATING OF RECOVERABLE SILVER FROM PHOTOGRAPHIC SOLUTIONS AND CELL WITH CURRENT CONTROL MEANS THEREFOR

BACKGROUND OF THE INVENTION

It is common practice to recover silver in expended "hypo" photographic fixing solutions by one of three prevalently used methods: (1) chemical precipitation, (2) metallic replacement (ion displacement), (3) electrolytic plating. The latter method, to which this invention pertains, consists of flowing a direct electric current through the "hypo" solution, between electrodes, which causes the silver to be deposited in a plate form on the negative electrode (the cathode). Numerous devices to accomplish this are known. The electrolytic plating method is generally conceded to be the most desirable of the three methods, since, if the current densities are controlled and adjusted to conform to the varying concentrations of silver in the "hypo" solutions, the efficiency of silver recovery can be greater than in other methods, and, when the concentration of silver in the "hypo" solution has been lowered substantially, permits the re-cycling and re-use of the solution, thereby permitting considerable monetary savings in the purchase of photographic chemical solutions. The controlling of the current densities has, heretobefore, been accomplished manually, or, in some devices, two pre-set current levels are made available, and their use is alternated by having a simple timing device activated by the intermittent in-flow of expended "hypo" solution. Neither method provides for a close match of an appropriate current level for the constantly changing silver concentration. Insufficient levels of current density for the available silver concentration results in loss of silver recovery efficiency; excessive levels of current density for the available silver concentration causes several undesirable effects, among which are the precipitation of silver as a silver sulfide, or in more extreme disparities, the creation of a noxious gas, hydrogen sulfide. It is the object of this invention to automatically closely match the proper current density with the constantly changing silver concentrations so as to minimize or completely eliminate these effects.

A further problem which arises in systems for recovering silver from solution by electroplating is that of removing the silver from the electroplating vat. This problem is solved, according to the invention, by employing a flexible cylindrical stainless steel cathode. Silver attached to the cathode can be removed by removing the entire cathode and thereafter flexing the cathode. The cathode may be smaller in diameter than the plastic vat containing the cathode, leaving a space through which overflow of the solution may proceed. The solution is continuously rotated by means of two paddles which assures that the concentration of silver solution adjacent the cathode will not be depleted. The paddles are driven by a magnetic coupling from interiorly of the anode, which is made of graphite.

SUMMARY OF THE INVENTION

This invention achieves a close match of current density with silver concentration in an electrolytic plating system for recovering silver from "hypo" solution, by utilizing the plating electrodes themselves as sensing elements in controlling the current. This utilization permits the sensing of both the change of conductivity characteristics of the "hypo" solution and the changes in the interface between the solution and the cathode. The control of the current is accomplished by means of a power supply with a special voltage-current response characteristic. The plating tank utilizes a flexible removable cathode to enable easy removal of plated on silver.

DETAILED DISCLOSURE OF A PREFERRED EMBODIMENT

Figure 1:
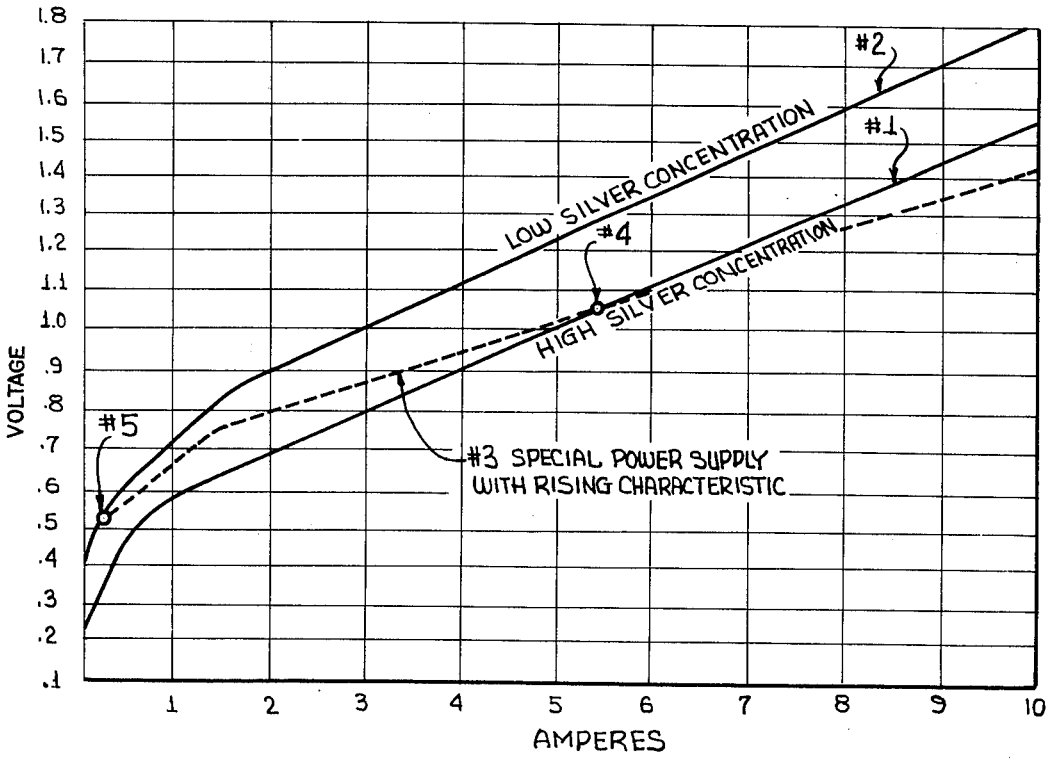
FIG. 1 is plot of voltage-current characteristics of an electrolytic silver recovery unit, for two diverse values of silver concentration, and in dotted line of a desired voltage-current characteristic, for the purposes of the present invention.

Referring to FIG. 1 of the accompanying drawings, plot No. 1 illustrates the volt-current characteristic of a "hypo" solution containing a high concentration of silver, approximately ten grams per liter. Plot No. 2 illustrates the corresponding characteristic for low silver concentration, about one gram per liter. These plots are approximate, or typical, since the precise characteristics will vary with the physical dimensions of the plating unit, the type of material on the electrodes and the conditions at the electrode surfaces produced by continuous plating.

Plot No. 3 shows that if the characteristics of the system are as in plot No. 1, current will rise to point No. 4, while if the characteristics of the system should change to that of plot No. 2, the current will fall to point No. 5.

Figure 2:
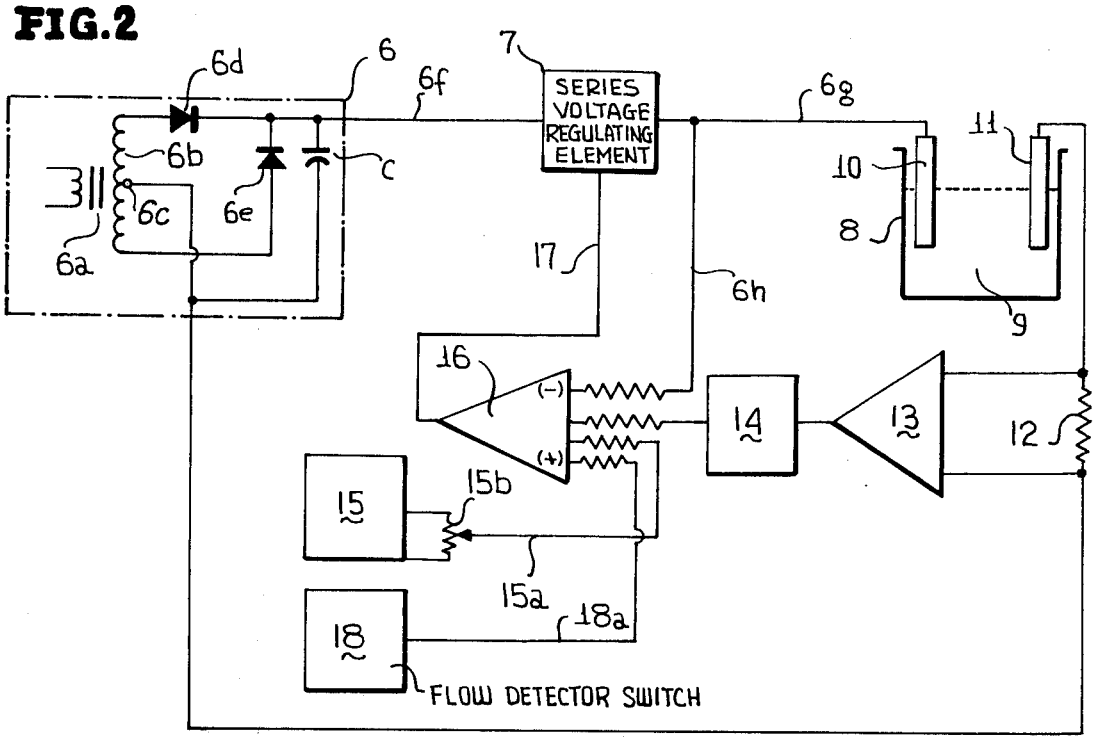
FIG. 2 is a block diagram of a system according to the invention.

Referring now to FIG. 2 of the accompanying drawings, 6 is an unregulated dc power supply, including a power transformer 6*a*, having a secondary winding 6*b* which is center tapped at 6*c*. The ends of secondary winding 6*b* are respectively connected to the anodes of diodes 6*d* and 6*e*, the anodes of which are connected together to a dc output line 6*f*, capacitor C providing filtering. The voltage on line 6*f* is unregulated.

Connected in series with line 6*f* is a series regulating circuit 7 which is per se conventional, and may include, for example, vacuum tubes, which are responsive to control voltage applied via line 17 to modify the resistance of the tubes and thereby to vary the voltage available on line 6*g*.

16 is a summing amplifier, of conventional character, to which is connected via line 15*a* adjustable dc voltage derived from a source 15, adjustment being made via potentiometer 15*b*. A further input to summing amplifier 16 is the voltage on line 6*g*, applied via line 6*h*.

8 is a plating tank containing electrolyte 9, an anode 10 and a cathode 11. Anode 10 is connected to line 6*g*, and cathode 11 via a small resistance 12 back to the center tap 6*c*. The voltage across resistance 12 is a function of current flow in cathode 11, and in fact is directly proportional to that current flow if resistance 12 is linear or follows Ohm's law.

13 is an amplifier used to amplify the voltage across resistance 12, and is required only if the voltage across resistance 12 is small, and to isolate resistance 12 from non-linear resistance 14. 18 is a switch and voltage source which can add a voltage via line 18*a* to an input of amplifier 16 when additional solution is added to the plating solution. The voltage versus current characteristic of the non-linear resistance 14 then determines the curve of voltage variation on line 6*g*, as a function of current through resistance 12.

With no current flowing the voltage on line 6*h* is set to equal that from voltage reference source 15. When current flows an additional voltage is applied to an input of amplifier 16, which causes the voltage on line 6*g* to increase. The precise amount of increase is determined by the value of resistance 12, the gain of amplifier 13, the V-A characteristic of resistance 14, and the characteristics of summing amplifier 16, and the V-A characteristic may be adjusted to simulate plot No. 3 of FIG. 1, or either of the other plots, as desired. Element 18 serves to add a slight additional voltage to line 6*g* whenever electrolyte is added, and to this end is preferably a flow detector switch. Thereby, when fresh electrolyte is being added, its flow closes switch 18, and adds to the voltage applied to the electrodes 10, 11.

It has been found that the voltage-current characteristic of the power supply 6 and regulator 7 should be such that for low currents characteristic No. 2 should be followed, near its low current range, but that as current increases actual voltage should be below that of curve No. 2, but above that of curve No. 1, until about 5.5 amperes of plating current flows. Thereafter, the voltage should fall slightly below that called for by plot No. 1, in order to eliminate precipitation of silver as a sulfide, or generation of hydrogen sulfide. The current flowing through the plating cell is properly a function of silver concentration in the solution, and it has been determined experimentally that plot No. 3 represents a V-A characteristic which optimizes removal of silver, as a function of available silver concentration, without loss of recovery efficiency or the production of the undesirable effects above described.

While a non-linear element 14 has been provided in cascade with amplifier 13, as a preferred embodiment, it would have been feasible to provide non-linearity in many ways known to the art, i.e., in a feedback network of amplifier 13, at point 12, in regulating element 7, or the like. Further, it may be noted that plot No. 3 is nearly linear. Therefore, it is feasible, as a rough approximation, though this is not optimum, to avoid all non-linearity in the voltage control loop.

Figure 4:
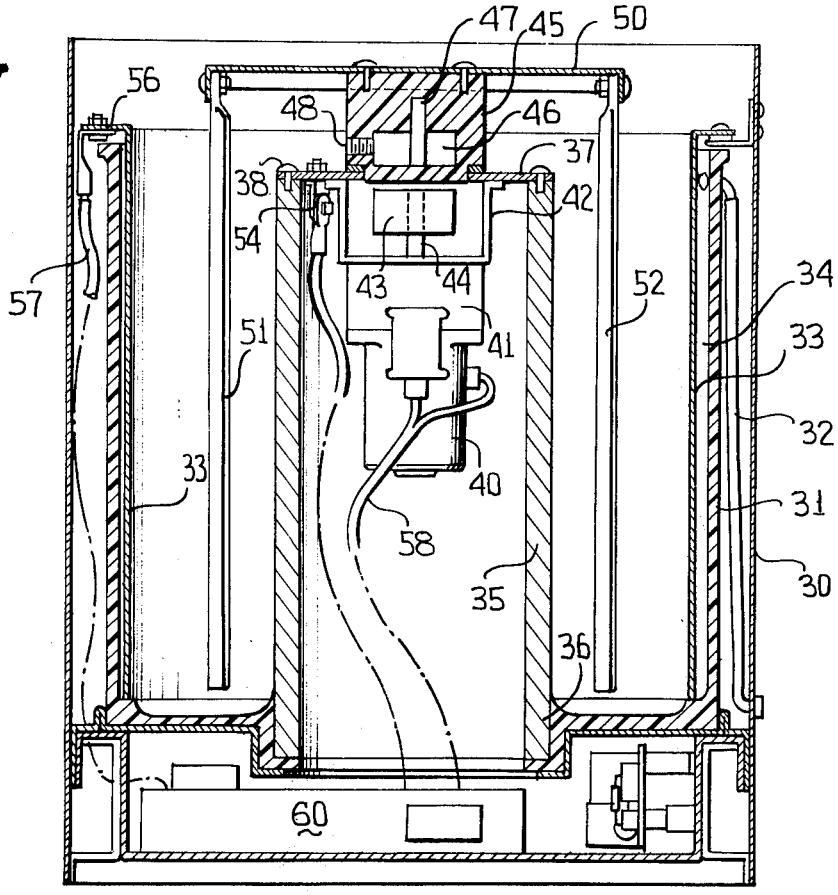
FIG. 4 is a transverse vertical section taken through FIG. 3.
Figure 3:
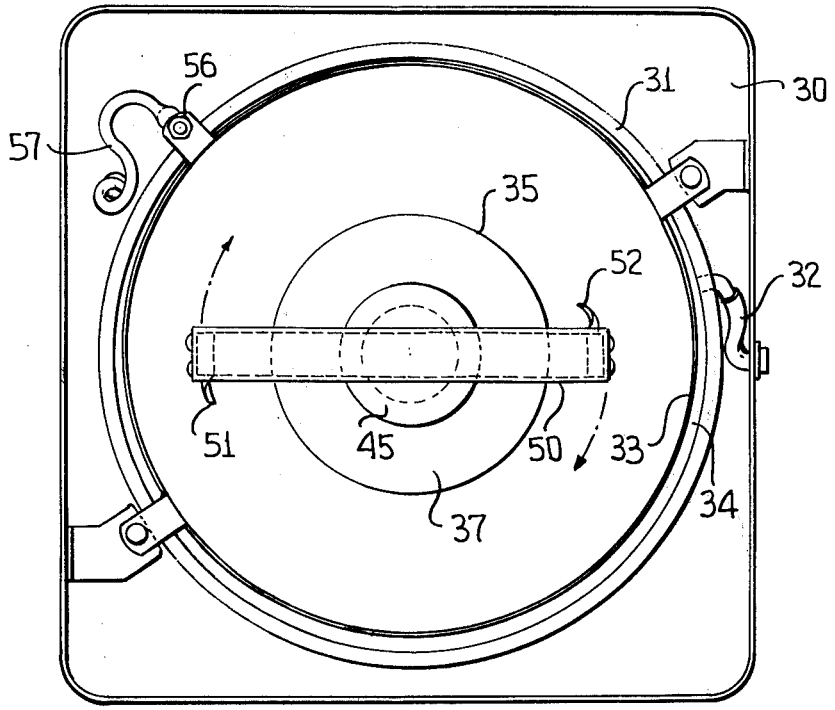
FIG. 3 is a top view of a plating tank, of the silver recovery unit employed in the system of FIG. 1.

Referring now to FIGS. 3 and 4, 30 is a metal enclosure containing a cylindrical plastic tank 31, having provision in the form of a pipe 32 for disposing of overflow. Within the tank 31 is a cylindrical cathode 33 of slightly smaller outer diameter than the inner diameter of the tank, to enable ready overflow of fluid from internally of the cathode to the tank 31 into the space 34. Silver is plated onto the cathode in the plating process. Removal of the silver is easily achieved by removing the cathode, and flexing the cathode to separate the silver coating from the cathode.

Internally of the cathode 33 is located a hollow cylindrical anode of graphite 35, secured near its bottom edge 36 to the plastic tank 31, to form a seal. The cathode may be typically about 4.0 inches D and the anode about 11.0 inches I.D. The cathode 35 is capped by a metal plate 37, bolted to the upper edge of the cathode by bolts 38. The plate 37 seals the interior of the anode 35, so that it is always free of fluid.

Suspended from the plate 37 is a motor assembly, including an electric motor 40, reduction gearing 41, and a drive magnet assembly 42. The latter includes a permanent magnet 43, which is driven by the motor shaft 44. A plastic enclosure 45 is secured to the upper surface of plate 37 and contains a magnet 46. The enclosure 45 is rotatable on plate 37, being secured to pin 47 and thereby to magnet 46, and rotates therewith. The magnet 46 is secured to enclosure 45 by set screw 48.

Belted to the upper surface of enclosure 45 is a stainless steel arm 50, from which are suspended a pair of plastic arms 51, 52, which extend to near to the bottom of tank 31, and serve to stir the liquid in the tank, so that the liquid adjacent to cathode is continually refreshed with silver solution, as silver is abstracted. In the absence of stirring silver would be depleted, adjacent to the cathode, by the plating action.

Connection to the anode is made via a clamp 54 and a lead 55. Connection to the cathode 33 is made by a clamp 56 and a lead 57. Power is supplied to motor 40 via leads 58. All leads proceed to a control box 60, the details of which are not germane to the invention, and are therefore not described.

What we claim is:

1. An electroplating system for removing silver from solution and for automatically closely matching the proper current density with changing silver concentrations in order to maximize silver conversion efficiency, which comprises a plating tank for said solution wherein said plating tank includes a cathode upon which said silver is to be plated and an anode, a control voltage regulatable source of DC voltage connected between said anode and said cathode, means for measuring the voltage across said cathode and said anode, and means for measuring the current flowing through said solution directly between said cathode and said anode to thereby sense the change in conductivity or resistance of the solution, said anode and said cathode act as sensing elements for measuring said voltage and said current, and analog circuit means responsive to the voltage across said anode and said cathode and the current flowing through said solution and thereby responsive to the resistance or conductivity of said solution for regulating said voltage in a predetermined voltage versus current characteristic to thereby automatically closely match the proper current density with changing silver concentration and the change of interface between the cathode and the solution in order to maximize silver conversion efficiency and minimize production of silver sulfide and production of hydrogen sulfide.

2. The electroplating system of claim 1 which includes a resistance in series with the cathode for sensing the current flowing through the said solution in terms of voltage across the resistance.

3. The electroplating system of claim 1 wherein said V-A characteristic is adjustable.

4. The electroplating system of claim 1 in which said source of DC voltage includes an unregulated rectifier in series with a voltage controllable resistance, and which includes means for converting said current to a proportional voltage, a summing amplifier for providing a control voltage, a source of reference voltage, and means for applying said reference voltage and said proportional voltage to inputs of said summing amplifier, and means for applying the output of said summing amplifier as said control voltage to said voltage controllable resistance.

5. The electroplating system of claim 4, wherein said means for applying said proportional voltage includes a non-linear means.

6. The electroplating system of claim 1 wherein said plating tank is a sealed plastic tank, wherein said cathode is a cylindrical flexible stainless steel open ended cylinder, said cathode being removable from said tank, whereby silver may be removed from said cathode following removal from said tank by flexing said cathode.

7. The electroplating system of claim 6 wherein said anode is a hollow graphite cylinder, and which further includes a rotatable magnetic drive including a first magnet located interiorly of said anode, a motor coupled to rotate said first magnet and located interiorly of said anode, a second rotatable magnet located above said graphite cylinder in solely magnetically coupled relation to said first magnet, and stirring means mechanically coupled to said second magnet and extending into said tank between said anode and said cathode.

8. The electroplating system according to claim 1, wherein is provided means for continuously agitating said solution in the space between said anode and said cathode.

9. The electroplating system according to claim 1, wherein said cathode and said anode are concentric cylinders, respectively of stainless steel and of graphite.

10. The electroplating system according to claim 9, wherein said cathode is of smaller diameter than the diameter of said tank, and which further includes means for clamping a point of said cathode to a wall of said tank, said cathode being sufficiently flexible that deposited silver may be removed from said cathode by manually flexing said cathode.

11. An electroplating process for removing silver from solution and for automatically closely matching the proper current density with changing silver concentrations in order to maximize silver conversion efficiency which comprises, introducing said solution into a plating tank which includes a cathode upon which said silver is to be plated and an anode; measuring the voltage across said cathode and said anode and measuring the current flowing through said solution directly between said cathode and said anode by employing said cathode and said anode as sensing elements; and regulating the voltage to the plating tank in response to the voltage across said cathode and said anode and the current flowing through the solution directly between said cathode and said anode to thereby automatically closely match the proper current density with changing silver concentration in order to maximize silver conversion efficiency and at least minimize precipitation of silver sulfide and production of hydrogen sulfide.

12. The process of claim 11 which further comprises agitating said solution in the space between said anode and said cathode.

13. The process of claim 11 wherein said cathode is a cylindrical flexible stainless steel open ended cylinder and which further includes removing said cathode from said tank after the electroplating and then flexing said cathode to thereby remove deposited silver therefrom.

14. The process of claim 11 which further includes converting said current to a proportional voltage, applying said proportional voltage and a reference voltage to a summing amplifier, and applying the output of the summing amplifier as a control voltage for regulating the voltage to the plating tank.

15. A plating tank comprising a hollow cylindrical cathode being flexible and open ended and being removable from said tank and which can be flexed manually; a hollow cylindrical anode located internally of said hollow cylindrical cathode, a rotatable magnetic drive including a first magnet located interiorly of said anode, a motor coupled to rotate said first magnet and located interiorly of said anode, a second rotatable magnet located above said cylindrical anode in solely magnetically coupled relation to said first magnet, and stirring means mechanically coupled to said second magnet and extending into said tank between said anode and said cathode.

16. The plating tank of claim 15 wherein said cathode is a cylindrical flexible stainless steel open ended cylinder.

17. The plating tank of claim 15, wherein said plating tank is a sealed plastic tank and said cathode is a cylindrical flexible stainless steel open ended cylinder.

18. The plating tank of claim 15, wherein said cathode and said anode are hollow concentric cylinders, respectively of stainless steel and of graphite.

19. The combination according to claim 15, wherein said cathode is of smaller diameter than the diameter of said tank, and which further includes means for clamping a point of said cathode to a wall of said tank.

20. The plating tank of claim 15 wherein said anode is a hollow graphite cylinder.

* * * * *